US006398097B1

(12) United States Patent
Liang

(10) Patent No.: US 6,398,097 B1
(45) Date of Patent: Jun. 4, 2002

(54) NAIL PRESS STRUCTURE OF A NAIL EJECTION GUN

(76) Inventor: Lin Chi Liang, 5Fl., No. 536-6, Dajin St., Nantuen Chiu, Taichung (TW), 408

( * ) Notice: Subject to any disclaimer, the term of this patent is extended or adjusted under 35 U.S.C. 154(b) by 0 days.

(21) Appl. No.: 09/876,027

(22) Filed: Jun. 8, 2001

(51) Int. Cl.[7] ..... B25C 1/04
(52) U.S. Cl. ..... 227/109; 227/120; 227/136
(58) Field of Search ..... 227/120, 119, 227/136, 109

(56) References Cited

U.S. PATENT DOCUMENTS 4,524,896 A * 6/1985 Morrell, Jr. ..... 227/109
4,815,647 A * 3/1989 Chou ..... 227/109
5,522,533 A * 6/1996 Mukoyama et al. ..... 227/109
5,588,577 A * 12/1996 Chen ..... 227/227
5,632,431 A * 5/1997 Lin ..... 227/120
5,743,453 A * 4/1998 Chuang ..... 227/120
6,161,746 A * 12/2000 Wey ..... 227/120

* cited by examiner

*Primary Examiner*—Scott A. Smith
(74) *Attorney, Agent, or Firm*—Rosenberg, Klein & Lee

(57) ABSTRACT

A nail press structure of a nail ejection gun includes a frame body having a nail outlet seat, and a nail magazine. The nail magazine includes an L-shaped magazine plate assembled with a magazine seat, such that a plurality of nails may be received in the space defined between the magazine seat and the magazine plate. The magazine seat is formed with a plurality of magazine grooves, and the magazine plate is formed with a hollow plate locked on the magazine seat. A plurality of elastic members are placed between the magazine seat and the magazine plate. A plurality of nail press members are respectively placed in the magazine grooves, located between the magazine seat and the elastic member, and are pressed by the elastic members.

6 Claims, 9 Drawing Sheets

NAIL PRESS STRUCTURE OF A NAIL EJECTION GUN

BACKGROUND OF THE INVENTION

1. Field of the Invention

The present invention relates to a nail press structure, and more particularly to a nail press structure of a nail ejection gun.

2. Description of the Related Art

A conventional nail ejection gun in accordance with the prior art shown in FIGS. 1 and 2 primarily comprises a frame body 1 having a front end transversely provided with a nail outlet seat 2, and longitudinally connected with a nail magazine 3. The nail outlet seat 2 includes a panel 201, and a nail plate 202 coupled with each other. The nail magazine 3 includes a magazine seat 301, and a magazine plate 302 assembled with the magazine seat 301. The magazine plate 302 is formed with transverse slots 303 and 304, and a drive plate 305 pivoted between transverse slots 303 and 304. An inverted L-shaped retaining plate 306 is locked on the bottom of the drive plate 305, and a chamber 307 is formed between the retaining plate 306 and the magazine seat 301 for receiving nails 4. A plurality of scales 308 are provided on one side of the slot 304, for facilitating adjusting the nails 4 of different lengths.

In use, the user has to previously adjust the drive plate 305 according to the length of the nail 4, to have a correct scale according to indication of the scales 308 of the magazine plate 302, so that the retaining plate 306 may form a proper chamber 307 previously. Next, the nails 4 may slide into the chamber 307, while the nail pusher 309 is rested on the nails 4, so that the nails 4 may be placed in the chamber 307 and retained by the retaining plate 306.

However, for facilitating displacement of the drive plate 305, the tension of the magazine seat 301 on the retaining plate 306 is very important. The drive plate 305 is not easily moved if the tension is too tight, and the nails are easily detached if the tension is too loose. In addition, the retaining plate 306 and the nail push portion 310 may be used to position the nails, but the conventional nail ejection gun is not provided with any member to position the nails in the longitudinal direction, so that the nails are also easily detached.

SUMMARY OF THE INVENTION

The primary objective of the present invention is to provide a nail press structure of a nail ejection gun that may be available to various nails without needing adjustment, and may prevent displacement of the nails.

In accordance with the present invention, there is provided a nail press structure of a nail ejection gun, comprising: a frame body having an end side transversely provided with a nail outlet seat, and longitudinally connected with a nail magazine, the nail magazine including a magazine seat, and an L-shaped magazine plate assembled with the magazine seat, such that a plurality of nails may be received in a space defined between the magazine seat and the magazine plate, a top face of the magazine seat formed with a plurality of longitudinal magazine grooves, a bottom of the magazine plate formed with a hollow plate locked at a top portion of a front section of the magazine seat; wherein,

- a plurality of elastic members are placed between the magazine seat and the magazine plate, and opposite located to an upper position of the magazine grooves;
- a plurality of nail press members are placed in the magazine grooves, located between the magazine seat and the elastic members, and are pressed by the elastic members.

Further benefits and advantages of the present invention will become apparent after a careful reading of the detailed description with appropriate reference to the accompanying drawings.

DETAILED DESCRIPTION OF THE INVENTION

Figure 1:
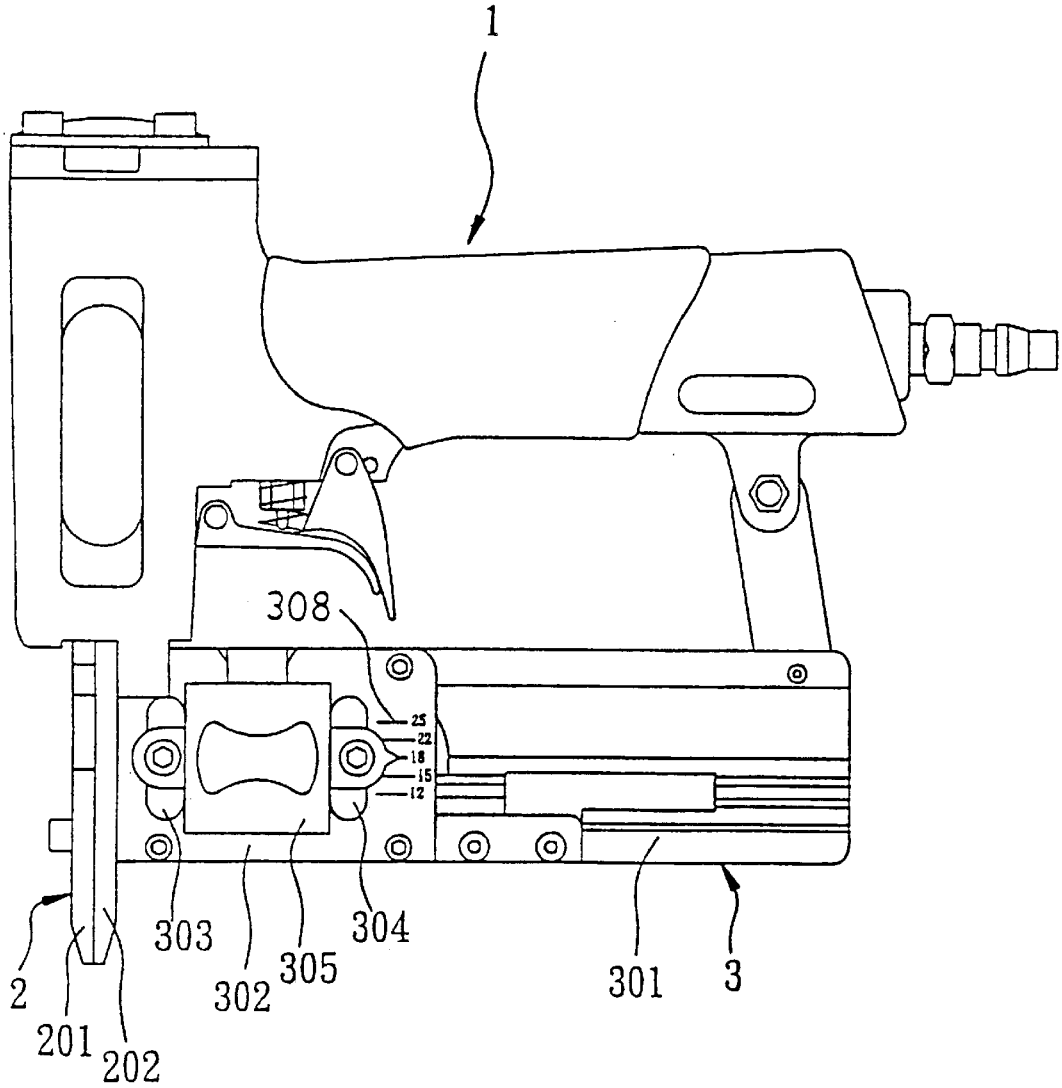
FIG.1 PRIOR ART
FIG. 1 is a front plan assembly view of a conventional nail ejection gun in accordance with the prior art.
Figure 2:
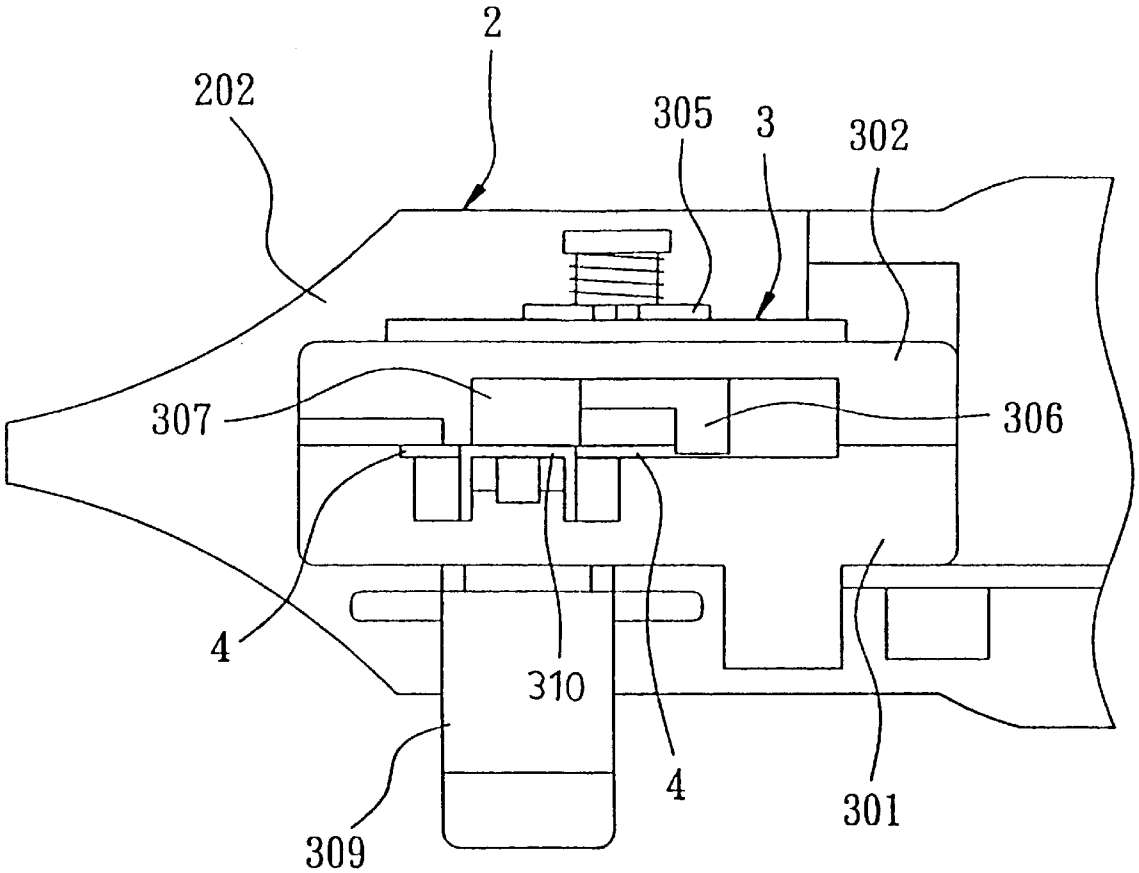
FIG.2 PRIOR ART
FIG. 2 is a side plan schematic view of the conventional nail ejection gun as shown in FIG. 1.
Figure 3:
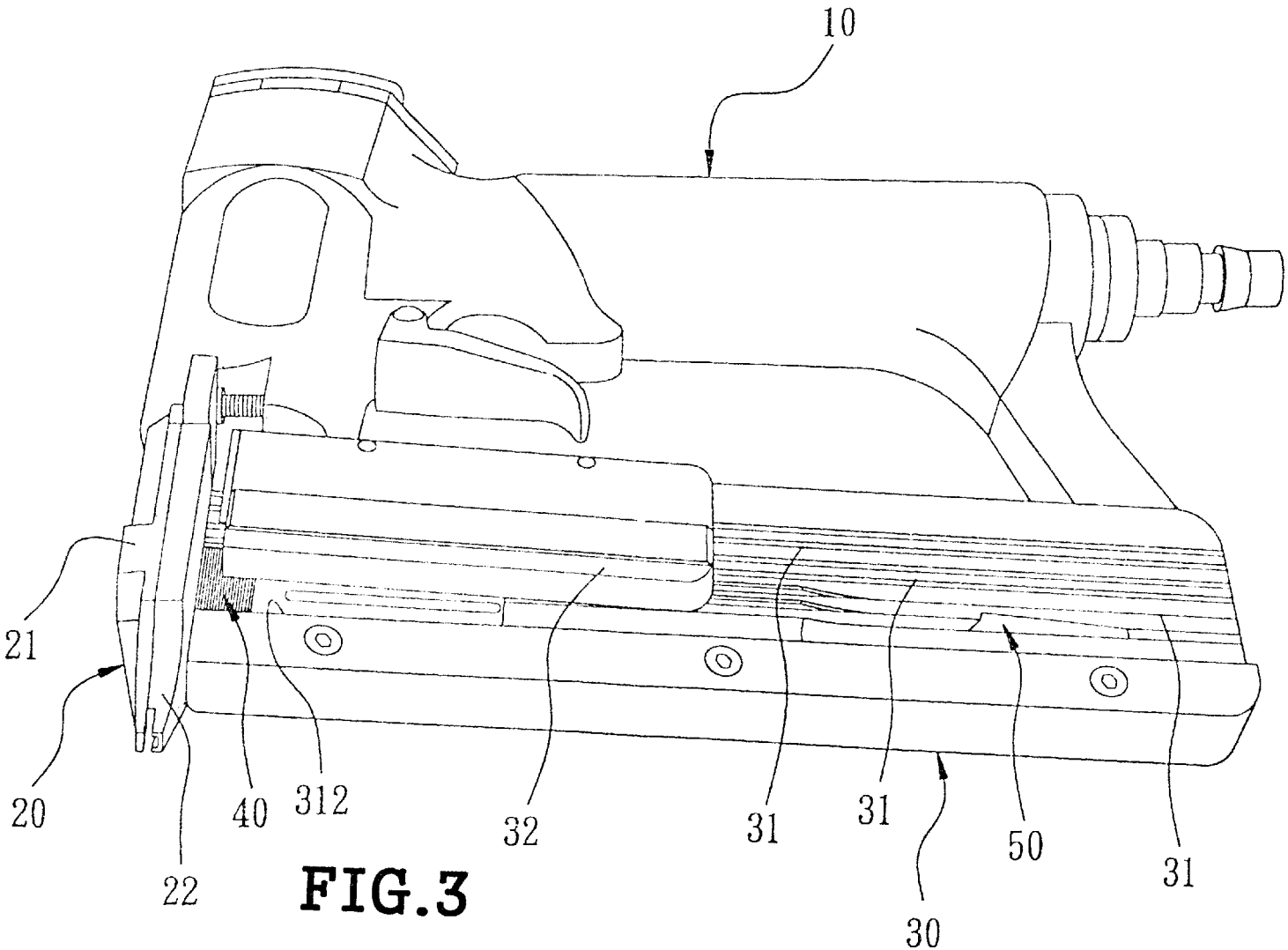
FIG. 3 is a perspective view of a nail press structure of a nail ejection gun in accordance with the preferred embodiment of the present invention.
Figure 4:
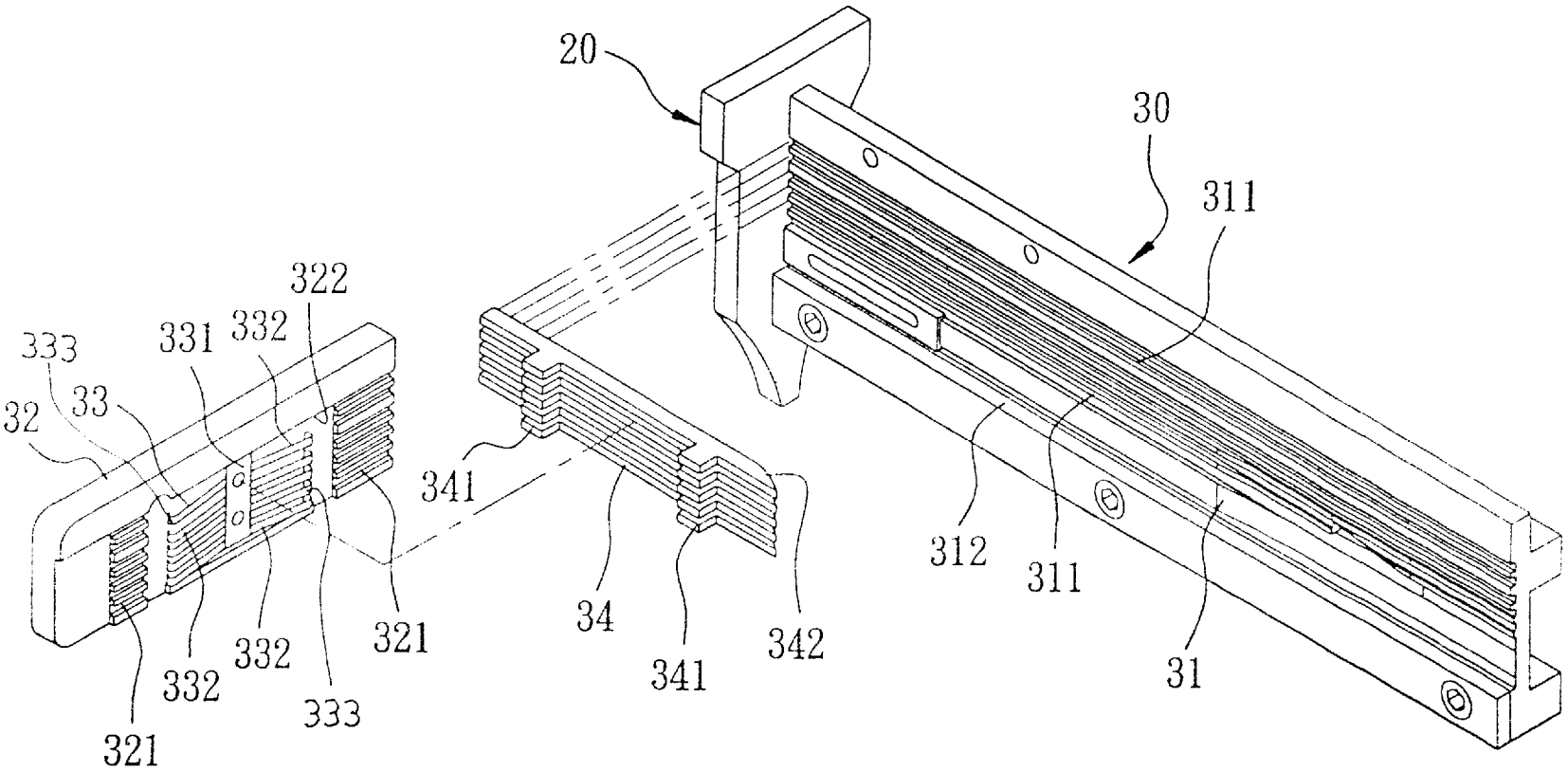
FIG. 4 is a partially exploded perspective view of the nail press structure of a nail ejection gun as shown in FIG. 3.

Referring to the drawings and initially to FIGS. 3 and 4, a nail press structure of a nail ejection gun in accordance with the preferred embodiment of the present invention primarily comprises a frame body 10 having an end side transversely provided with a nail outlet seat 20, and longitudinally connected with a nail magazine 30. The nail outlet seat 20 includes a panel 21, and a nail plate 22 coupled with each other. The nail magazine 30 includes a magazine seat 31, and an L-shaped magazine plate 32 assembled with the magazine seat 31, such that the nails 40 may be received in the space defined between the magazine seat 31 and the magazine plate 32. The top face of the magazine seat 31 is formed with a plurality of longitudinal magazine grooves 311. The bottom of the magazine plate 32 is formed with a hollow plate locked at the top portion of the front section of the magazine seat 31.

A set of elastic member 33 is placed between the magazine seat 31 and the magazine plate 32, and opposite located to the upper position of the magazine grooves 311. The elastic member 33 is substantially inverted V-shaped, and includes a horizontal body 331 whose two sides are provided with a plurality of juxtaposed elastic plates 332 extending downward in an oblique manner. In the preferred embodiment, the set of elastic members 33 may be formed integrally. The body 331 is secured on the hollow portion of the bottom of the magazine plate 32, and the tail portion of each elastic plate 332 is formed with a press portion 333.

Figure 7:
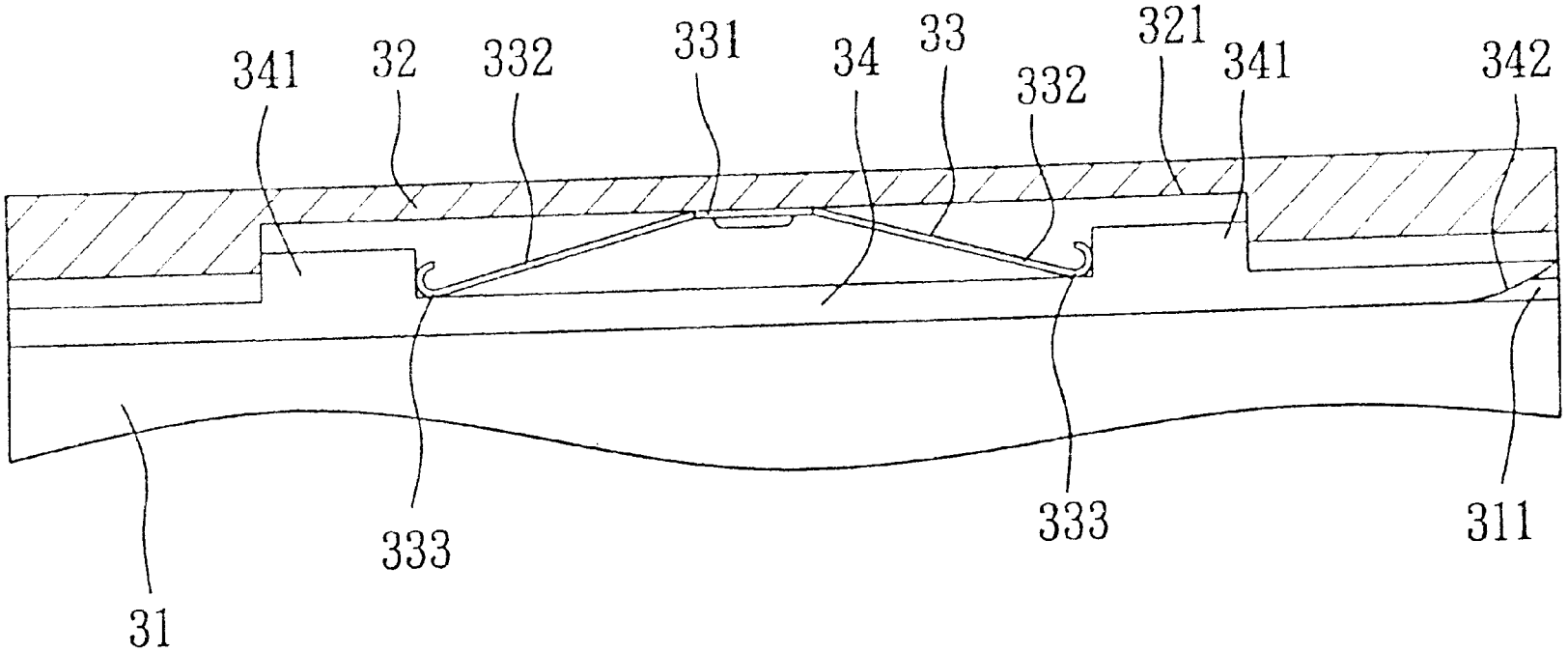
FIG. 7 is a side plan cross-sectional assembly view of the nail press structure of a nail ejection gun as shown in FIG. 3.

A plurality of nail press members 34 are placed in the magazine grooves 311, located between the magazine seat 31 and the elastic member 33, and are pressed by the elastic members 33. The top portion of each nail press member 34 is provided with two lugs 341. As shown in FIG. 7, the two lugs 341 are respectively located at the two sides of the press portion 333 of the elastic member 33, so that each nail press member 34 is retained by the press portion 333 of the elastic member 33 without a longitudinal displacement. In addition, the outer side of the nail press member 34 is provided with a nail guide portion 342 arranged from outside to inside in an oblique manner, for guiding the nails 40 into the nail magazine 30.

The magazine plate 32 is formed with a plurality of positioning grooves 321 to mate with the magazine grooves 311 of the magazine seat 31, so that the nail press members 34 are retained in the space formed between the magazine grooves 311 and the positioning grooves 321.

Figure 5:
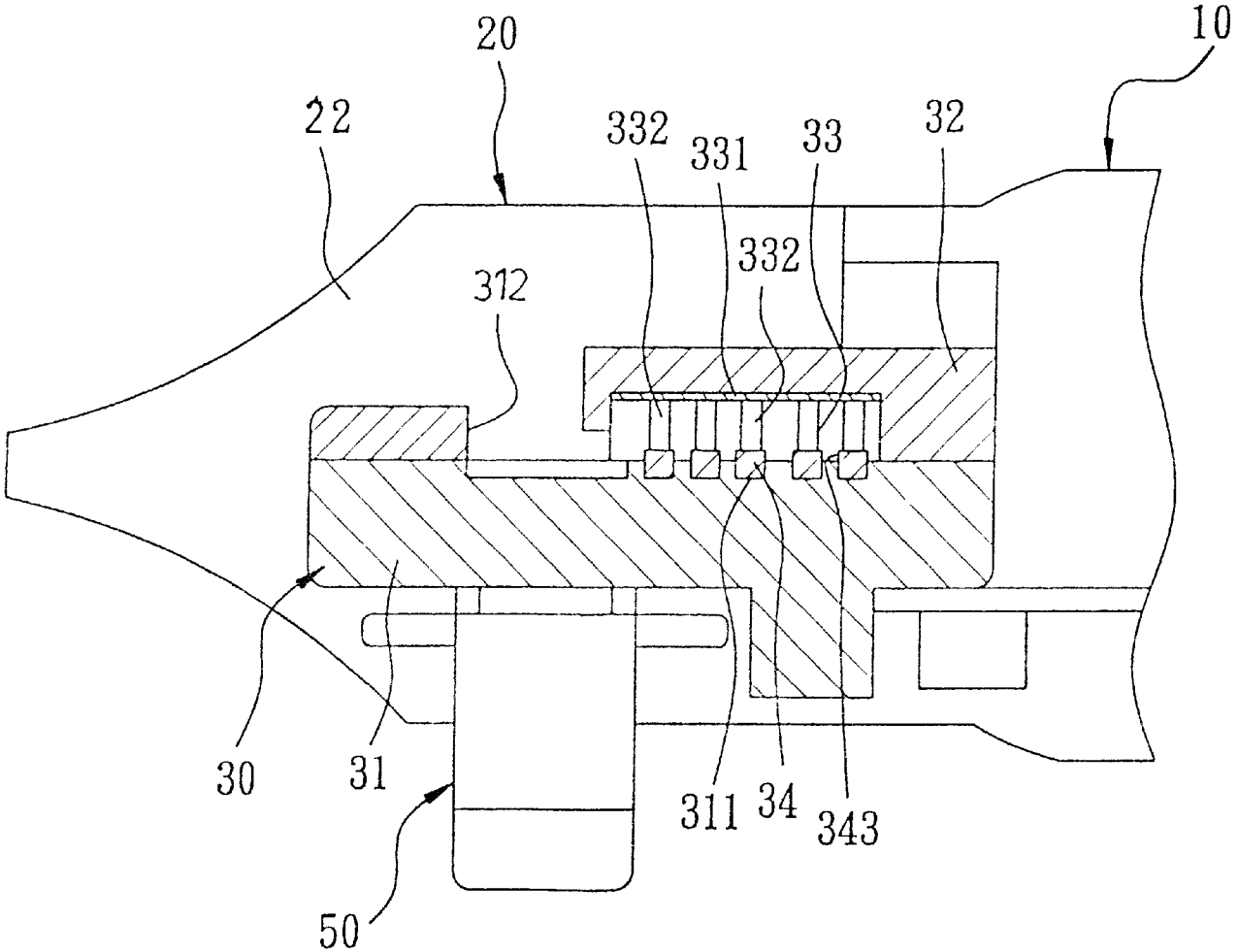
FIG. 5 is a cross-sectional assembly view of the nail press structure of a nail ejection gun as shown in FIG. 3.
Figure 6:
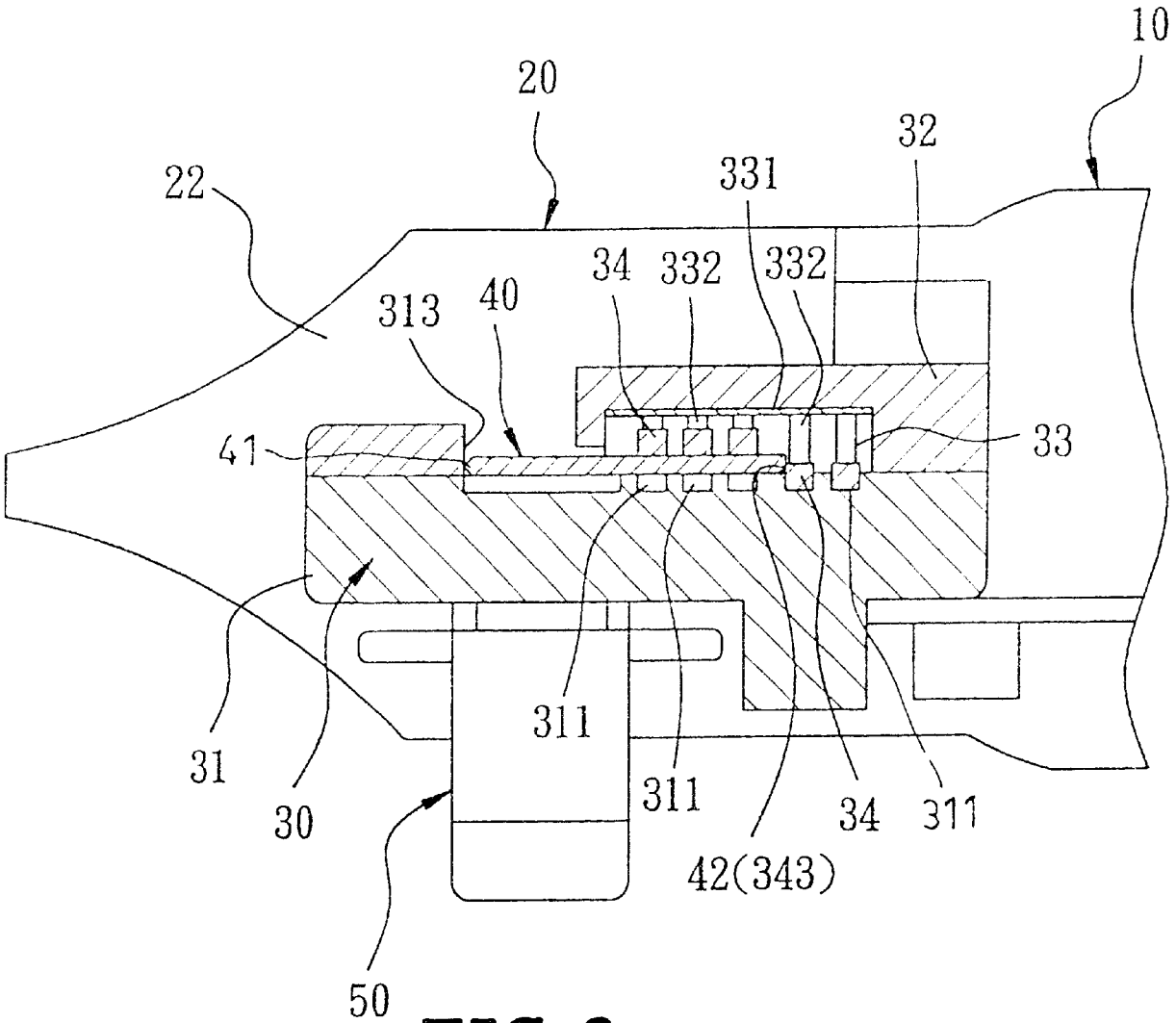
FIG. 6 is a schematic operational view of the nail press structure of a nail ejection gun as shown in FIG. 5.
Figure 8:
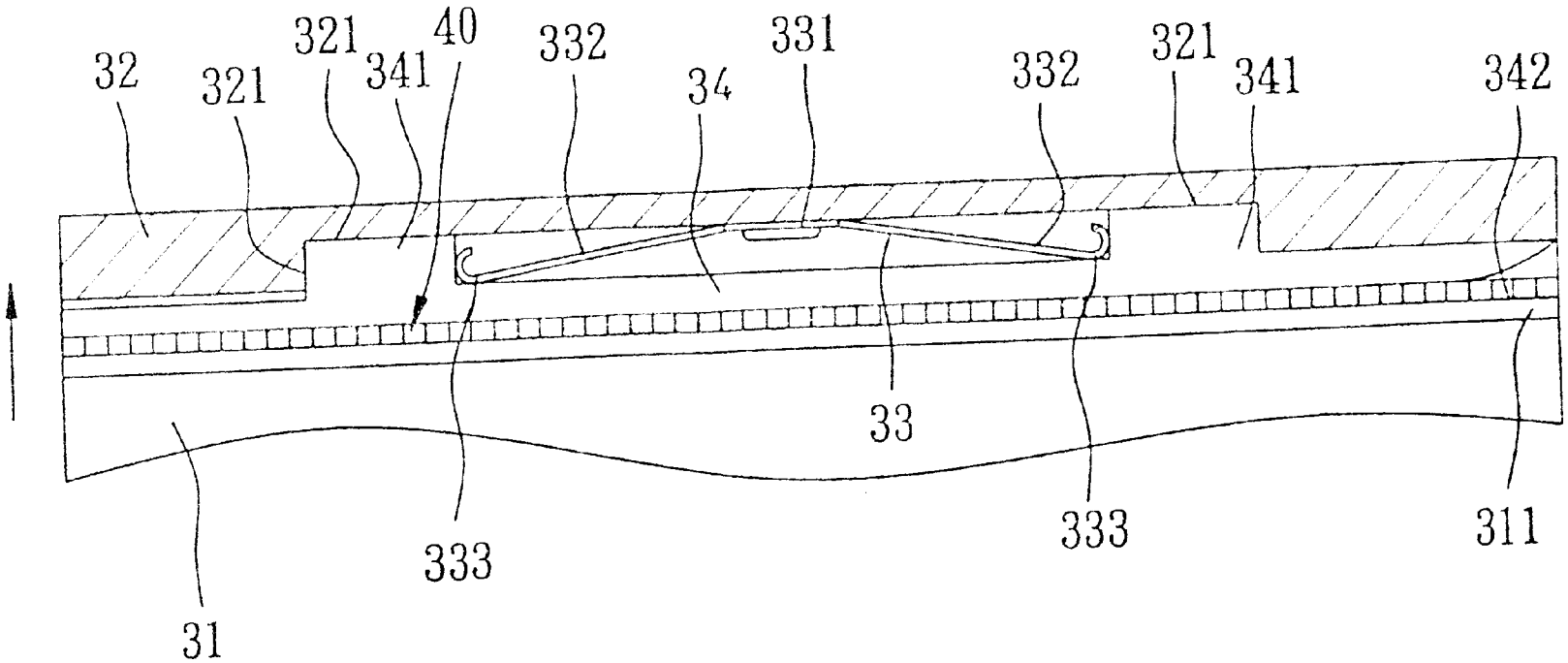
FIG. 8 is a schematic operational view of the nail press structure of a nail ejection gun as shown in FIG. 7.

Referring to FIGS. 5 and 7, the nail press structure of a nail ejection gun in accordance with the preferred embodiment of the present invention is in use. First, before the nails 40 slide into the nail magazine 30, each elastic plate 332 of the elastic member 33 fixed on the magazine plate 32 elastically presses the nail press member 34 in the magazine grooves 311 of the magazine seat 31. At this time, the nail press member 34 is pressed by the press portion 333 of the elastic plate of the elastic member 33 to touch the magazine groove 311. Next, as shown in FIGS. 6 and 8, when the nails 40 are to be placed into the nail magazine 30, the nails 40 may slide into the nail magazine 30 by the nail guide portion 342 of the nail press member 34. At this time, the elastic plates 332 of the elastic member 33 are arranged in a spaced manner to mate with the nail press member 34. Thus, after the nails 40 having shorter lengths slide into the nail magazine 30, only three nail press members 34 at the outer side are pushed upward. The three nail press members 34 at the outer side are pushed by the nails 40 to press the elastic plates 332 of the elastic member 33, so that three elastic plates 332 at the outer side are subjected to a force to spring upward. During the springing process, the upward springing arc of the elastic plate is equal to the thickness of the nail 40. At this time, the nails 40 are urged by the nail press members 34 to press the magazine seat 31. Thus, when the nail pusher 50 positions the nails 40, the nails 40 are positioned by the nail press members 34 along the longitudinal direction. In addition, the tip 41 of each nail 40 presses the inner side wall 312 of the magazine seat 31, while the tail 42 of each nail 40 is rested on the side wall 343 of the nail press member 34 that is not lifted, so that the nails 40 can be efficiently positioned along the transverse direction.

Figure 9:
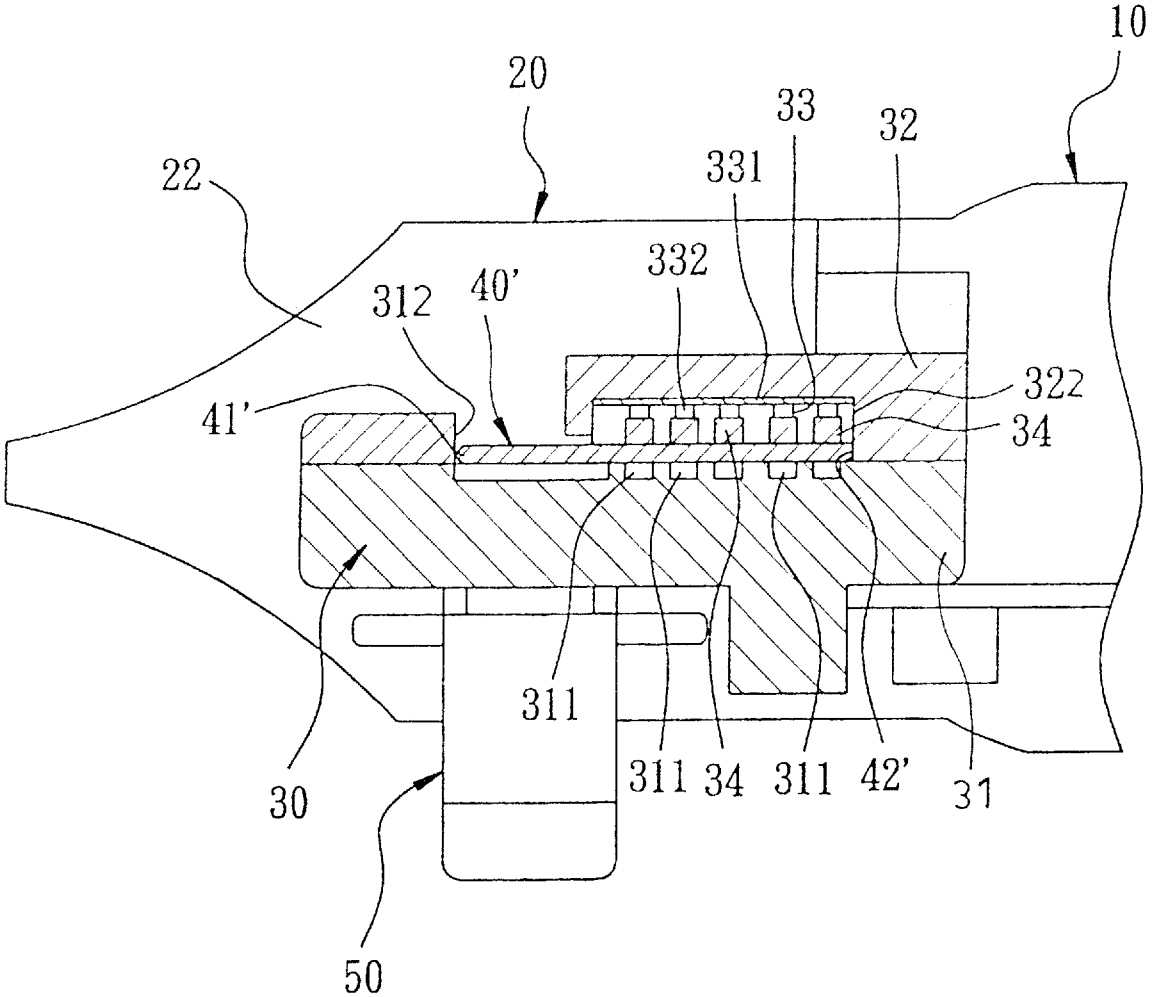
FIG. 9 is a schematic operational view of the nail press structure of a nail ejection gun as shown in FIG. 5.

In addition, as shown in FIG. 9, the nail 40' has a greater length. When the nails 40' slide into the nail magazine 30, all of the nail press members 34 are pushed upward by the nail 40'. At this time, the tip 41' of each nail 40' presses the inner side wall 312 of the magazine seat 31, while the tail 42' of each nail 40' is rested on the inner side wall 322 of the hollow space of the bottom of the magazine plate 32, so that each of the nails 40' can be efficiently positioned along the longitudinal direction and the transverse direction.

Accordingly, the nail press structure of a nail ejection gun in accordance with the preferred embodiment of the present invention has the following advantages:

1. The elastic member 33 on the magazine plate 32 may co-operate with the nail press member 34 on the magazine seat 31, so that the nails 40 can be conveniently mounted into the nail magazine 30. Next, the elastic plates 332 of the elastic member 33 respectively press the nail press members 34 that are arranged in a spaced manner, such that when the nails 40 slide into the nail magazine 30, the nails 40 are elastically biased by the elastic plates 332 of the elastic member 33, and pressed by the nail press members 34 without incurring the nail detachment phenomenon as that happens in the conventional nail ejection gun.

2. According to the lengths of different nails 40, the inner side wall 343 of the nail press member 34 that is not lifted by the nail 40 may function to position the nails 40 along the transverse direction, so that the nails 40 can obtain the optimal positioning effect along both of the longitudinal direction and the transverse direction, thereby facilitating operation of the nail ejection gun.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A nail press structure of a nail ejection gun, comprising: a frame body having an end side transversely provided with a nail outlet seat, and longitudinally connected with a nail magazine, the nail magazine including a magazine seat, and an L-shaped magazine plate assembled with the magazine seat, such that a plurality of nails may be received in a space defined between the magazine seat and the magazine plate, a top face of the magazine seat formed with a plurality of longitudinal magazine grooves, a bottom of the magazine plate formed with a hollow plate locked at a top portion of a front section of the magazine seat; wherein, a plurality of elastic members are placed between the magazine seat and the magazine plate, and opposite located to an upper position of the magazine grooves;

a plurality of nail press members are placed in the magazine grooves, located between the magazine seat and the elastic members, and are pressed by the elastic members.

2. The nail press structure of a nail ejection gun in accordance with claim 1, wherein the magazine plate is formed with a plurality of positioning grooves to mate with the magazine grooves of the magazine seat, so that the nail press members are retained in a space formed between the magazine grooves and the positioning grooves.

3. The nail press structure of a nail ejection gun in accordance with claim 1, wherein the elastic member is substantially inverted V-shaped, and includes a horizontal body whose two sides are provided with a plurality of juxtaposed elastic plates extending downward in an oblique manner, the body is secured on a hollow portion of the bottom of the magazine plate, and a tail portion of each elastic plate is formed with a press portion.

4. The nail press structure of a nail ejection gun in accordance with claim 3, wherein a top portion of each nail press member is provided with two lugs, the two lugs are respectively located at two sides of the press portion of the elastic member, so that each nail press member is retained by the press portion of the elastic member without a longitudinal displacement.

5. The nail press structure of a nail ejection gun in accordance with claim 1, wherein the elastic members are integrally formed with each other.

6. The nail press structure of a nail ejection gun in accordance with claim 1, wherein an outer side of the nail press member is provided with a nail guide portion arranged from an outside to an inside in an oblique manner, for guiding the nails into the nail magazine.

* * * * *